United States Patent [19]

Brand

[11] Patent Number: 4,503,896

[45] Date of Patent: Mar. 12, 1985

[54] DOG SYSTEM FOR VENEER SLICER

[75] Inventor: Robert D. Brand, Lawrence, Ind.

[73] Assignee: Capital Machine Company, Inc., Indianapolis, Ind.

[21] Appl. No.: 576,942

[22] Filed: Feb. 3, 1984

Related U.S. Application Data

[63] Continuation of Ser. No. 403,469, Jul. 30, 1982, abandoned.

[51] Int. Cl.[3] ..... B27L 5/08

[52] U.S. Cl. ..... 144/369; 144/178

[58] Field of Search ..... 144/178, 369

[56] References Cited

U.S. PATENT DOCUMENTS

| | | | |
|---|---|---|---|
| 3,441,069 | 4/1969 | Koss | 144/178 |
| 3,680,612 | 8/1972 | Hale | 144/178 |
| 3,905,408 | 9/1975 | Hale | 144/178 |

FOREIGN PATENT DOCUMENTS 187296 12/1955 Austria .

*Primary Examiner*—W. D. Bray

*Assistant Examiner*—Jorji M. Griffin

*Attorney, Agent, or Firm*—Barnes & Thornburg

[57] ABSTRACT

A veneer slicer comprises a reciprocating flitch table providing a mounting surface for a flitch, a knife and pressure bar assembly movable along a path normal to the mounting surface, top and bottom dogs for gripping the flitch and holding the flitch against a central portion of the mounting surface, an intermediate dog mounted on the flitch table in proximity to the central portion of the mounting surface, a projecting device for projecting the intermediate dog from a retracted position within the flitch table to a projected position a distance from the mounting surface, and a power system for moving the top and bottom dogs toward the central portion of the mounting surface to concurrently grip and hold two sections of the flitch against the mounting surface. The top and intermediate dogs grip opposite portions of one of the flitch sections, and the bottom and intermediate dogs grip opposite portions of the other flitch section. The projecting device includes a spring for yieldably biasing the intermediate dog toward either its retracted or projected position.

6 Claims, 5 Drawing Figures

DOG SYSTEM FOR VENEER SLICER

This application is a File Wrapper Continuation of application Ser. No. 403,469 filed July 30, 1982 and abandoned Apr. 9, 1984.

The present invention relates to veneer slicers, and more particularly to a dog assembly mounted on the flitch table to the veneer slicer intermediate top and bottom dog assemblies to make it possible to simultaneously grip two sections of a flitch.

Top and bottom dog assemblies for veneer slicers are generally well known. Typically, the top and bottom dogs grip a conventional flitch and restrain the flitch against a vertical mounting surface on a flitch table. A conventional flitch is a portion of a log that has been split longitudinally to provide a flat mounting surface. A knife and pressure bar assembly is mounted on the veneer slicer facing the mounting surface so that as the flitch table moves downwardly, the fixed knife edge slices a thin sheet of veneer from the flitch. In addition, extension dog assemblies are known. The extension dog assemblies enable the veneer slicer to accommodate a generally cylindrical flitch which has not been split longitudinally. The cylindrical flitches cannot be gripped by top and bottom dogs alone. Extension dogs customarily grip the flitch at a distance from the mounting surface nearly equal to the radius of the cylindrical flitch, while the top and bottom dogs grip the flitch at a relatively short distance from the mounting surface.

Unfortunately, a portion of many of the sheets of veneer sliced on a conventional veneer slicer from a conventional flitch has a rough surface texture. This imperfection occurs when the knife edge adversely encounters the medullary rays of the flitch at the start of a slicing pass. Past the midway point of the slicing pass, the knife edge no longer adversely encounters the medullary rays and thus the surface texture is smooth. This roughness can be minimized by longitudinally splitting the conventional flitch, and independently mounting each resulting flitch section so that the medullary rays of each flitch section are aligned in a favorable manner with respect to the knife edge. Using this procedure, a substantially smooth veneer sheet can be produced from each flitch section. However, such an operation is time-consuming since the conventional flitch table is unable to accommodate more than one flitch or flitch section at a time. Requiring each flitch section to be sliced independently increases the slicing cycle time by a factor of two and the resulting waste of labor and resources is commercially unacceptable.

The present invention is designed for use on a conventional veneer slicer, and includes a plurality of dog asemblies mounted on the flitch table of the slicer intermediate the conventional top and bottom dogs. The intermediate dog assemblies are designed to grip the adjacent inwardly facing surfaces of each of two longitudinal flitch sections. The intermediate dogs include dogging plates for gripping and holding the two flitch sections between the top and bottom dogs, means for mounting the dogging plates on the flitch table, and means for projecting the dogging plates beyond the plane of the mounting surface of the flitch table. The projecting means includes yieldable means for biasing the dogging plates toward either the projected position or a retracted position within the flitch table.

Further, each intermediate dog assembly includes a vertically elongated rigid frame which is mounted on the flitch table in spaces provided between the conventional dogs on a flitch table.

Features and advantages of the present invention will become apparent in view of the following detailed description of one embodiment thereof, exemplifying the best mode of carrying out the invention as presently perceived, which description should be considered in conjunction with the accompanying drawings, in which.

Figure 1:
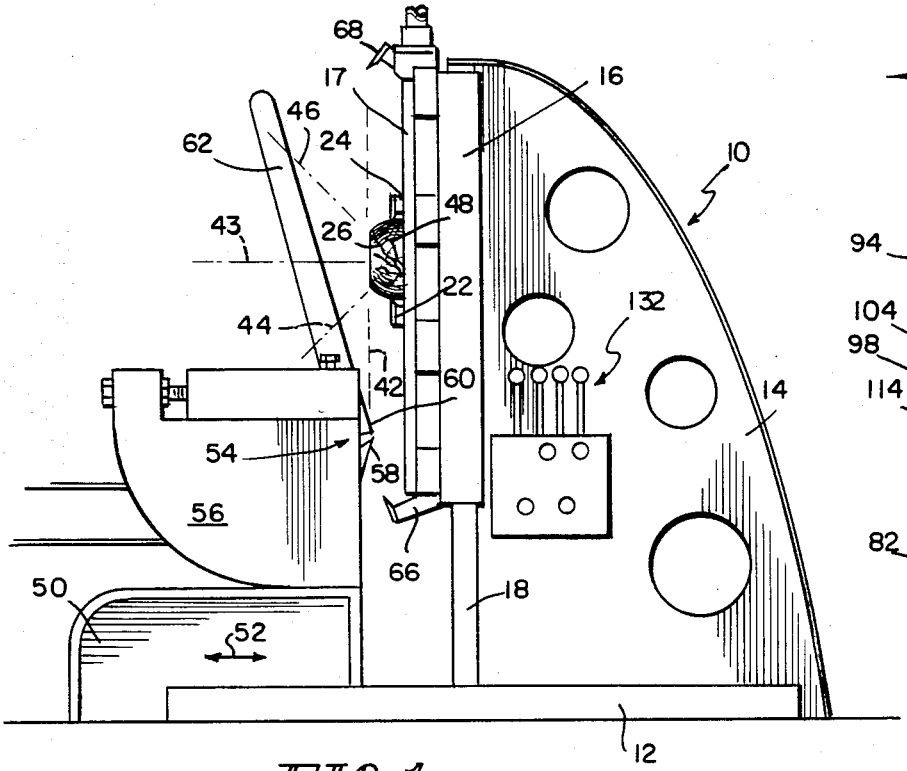
FIG. 1 is a side elevational view of a veneer slicer showing top and bottom dogs gripping a conventional flitch.
Figure 2:
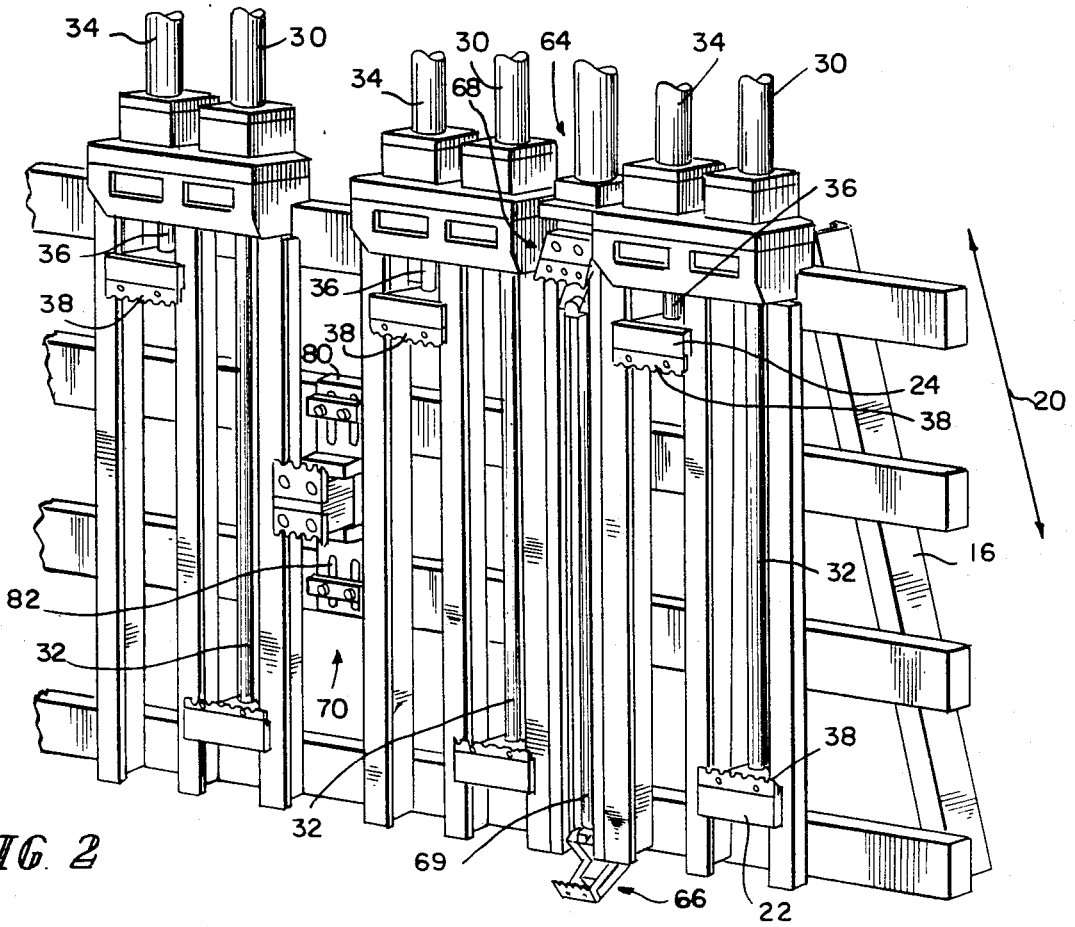
FIG. 2 is a fragmentary perspective view of a portion of the flitch table of the slicer of FIG. 1, including intermediate dogs embodying the present invention.

Referring now to the drawings, and particularly to FIGS. 1 and 2, a veneer slicer 10 embodying the present invention includes a base 12, flitch table supports 14 (only one of which is shown in the drawings), and a flitch table 16. The plurality of transversely spaced-apart supports 14 provide guides such as indicated at 18 upon which the flitch table 16 reciprocates in a generally vertical plane, as indicated by the arrow 20 in FIG. 2. The means by which the flitch table 16 is supported for reciprocation is well known.

A conventional flitch 26 is a portion of a generally cylindrical log that has been split longitudinally to provide a flat rear-mounting surface. As a result of a tree's growth pattern, many logs have a multiplicity of medullary rays extending radially outwardly from the center of the log. The number and pattern of the medullary rays vary, depending upon the type of tree.

A plurality of transversely spaced-apart dogs 22 and 24 are mounted on the flitch table 16 for gripping the flitch 26 at relatively short distances from the mounting surface 17 and holding the flitch 26 rigidly against a central portion of the mounting surface 17. In the illustrative embodiment, bottom dogs 22 and top dogs 24 vertically reciprocate on the flitch table 16 and are driven by hydaulic cylinders 30 and 34, respectively. Other power means may be employed for moving the dogs 22 and 24. The flitch 26 is held against the central portion of the mounting surface 17 so that it extends longitudinally therealong. The bottom dogs 22 are driven upwardly and the top dogs 24 are driven downwardly to engage the flitch 26 and hold the flitch rigidly against the mounting surface 17. The hydraulic cylinders 30 and 34 and their respective piston rods 32 and 36 drive the teeth portions 38 of the dogs 22 and 24 into the flitch 26. The teeth portions 38 are designed to wedge the rear surface of the flitch 26 tightly against the mounting surface 17 of the flitch table 16.

The slicer 10 includes a carriage 50 mounted on the base 12. Carriage 50 moves toward and away from the vertical plane of the flitch table 16 as indicated by the arrow 52. Means for moving the carriage 50 in the direction of the arrow 52 is well known and conventional. A knife and pressure bar assembly, indicated generally by the reference numeral 54, is mounted on the carriage 50 so that the assembly is movable with the carriage 50 toward and away from the mounting surface 17 of the flitch table 16. In the illustrated slicer 10, a member 56 (commonly called a knife bar) is provided for supporting the knife 58 at a point just below the pressure bar 60. The pressure bar 60 is carried by an assembly 62 (commonly called a pressure cap) which is adjustably movable on the knife bar 56. This arrangement of a knife 58, pressure bar 60, knife bar 56, and pressure cap 62 are well known.

From the description thus far, it will be appreciated that the flitch table 16 reciprocates transversely in a generally vertical plane relative to the path of movement of the knife and pressure bar assembly 54. The table 16 moves in the vertical plane between first and second opposite positions, i.e., upper and lower positions. As the flitch table 16 moves downwardly, the knife and pressure bar assembly 54 slices a thin sheet of veneer from the flitch 26. The assembly 54 is advanced step-by-step toward the flitch table 16, the distance of each step being approximately equal to the thickness of the slice of veneer being cut and each step being completed before the table 16 begins to move downwardly. Means, not shown, are provided for tilting the assembly 54 rearwardly after each slice to permit the table 16 and the flitch 26 to move to its upper position from its lower position.

In addition to the bottom and top dog assemblies 22 and 24, the flitch table 16 often includes a plurality of extension dog assemblies (one such assembly being indicated generally by the reference numeral 64 in FIG. 2) mounted on the flitch table 16. The extension dogs are designed to grip a generally cylindrical flitch (not shown), i.e., a log which has not been cut longitudinally, at a distance from the mounting surface 17 of the flitch table 16 greater than the gripping distance of the bottom and top dogs 22 and 24. As shown in FIGS. 1 and 2, when not in use, the extension dog assemblies 64 are positioned so that they will not cross the path of the knife and pressure bar assembly 54. Each extension dog assembly 64 includes a bottom extension dog 66, top extension dog 68, and a hydraulic cylinder-piston rod assembly 69 for moving the extension dogs 66 and 68. The hydraulic assembly 69 operates to drive the bottom extension dog 66 and the top extension dog 68 inwardly toward each other to engage the generally cylindrical flitch and hold it against the mounting surface 17 of the flitch table 16.

The conventional flitch 26 is usually gripped by several pairs of top and bottom dogs 22 and 24 so that the flitch 26 is securely held against the mounting surface 17 of the flitch table 16 as shown in FIG. 1. Alternatively, the flitch 26 could be gripped initially by several extension dog assemblies 64 in addition to the bottom and top dogs 22, 24 until movement of the knife and pressure bar assembly 54 to the right (FIG. 1) places it in close proximity to the vertical plane of movement of the flitch table 16. When no longer required, the extension dogs 66 and 68 would be removed to their respective releasing positions (FIG. 1) and the flitch 26 would remain secured, held only by the bottom and top dogs 22, 24.

The position of the knife and pressure bar assembly relative to the reciprocating mounting surfaces 17 defines a vertical cutting plane 42, represented by the phantom line in FIG. 1. As the flitch table 16 is moved downwardly, the knife and pressure bar assembly 54 slices a thin sheet of veneer from the flitch 26 in the cutting plane 42. During a cutting pass, the cutting plane 42 intersects planes 44 and 46 of the medullary rays 48. The surface texture of a sliced veneer sheet is primarily a function of the slope of the planes 44 and 46 of the medullary rays 48 relative to the cutting plane 42. In a two-dimensional coordinate system where the vertical cutting plane 42 is the abscissa and a line 43 normal to the vertical cutting plane 42 is the ordinate, the normal line 43 has no slope. The slope of the planes 44 and 46 will vary in each slicing pass. Each sliced veneer sheet is endowed with a substantially smooth and commercially acceptable surface as long as the slope of a medullary ray 58 plane is negative. Such a negatively sloping plane 46 is represented by a phantom line in FIG. 1. However, when a medullary ray 58 plane has a positive slope (e.g., positively sloping plane 44), the knife edge 58 begins to gouge into the flitch 26, yielding a rough and commercially undesirable veneer surface texture.

Figure 3:
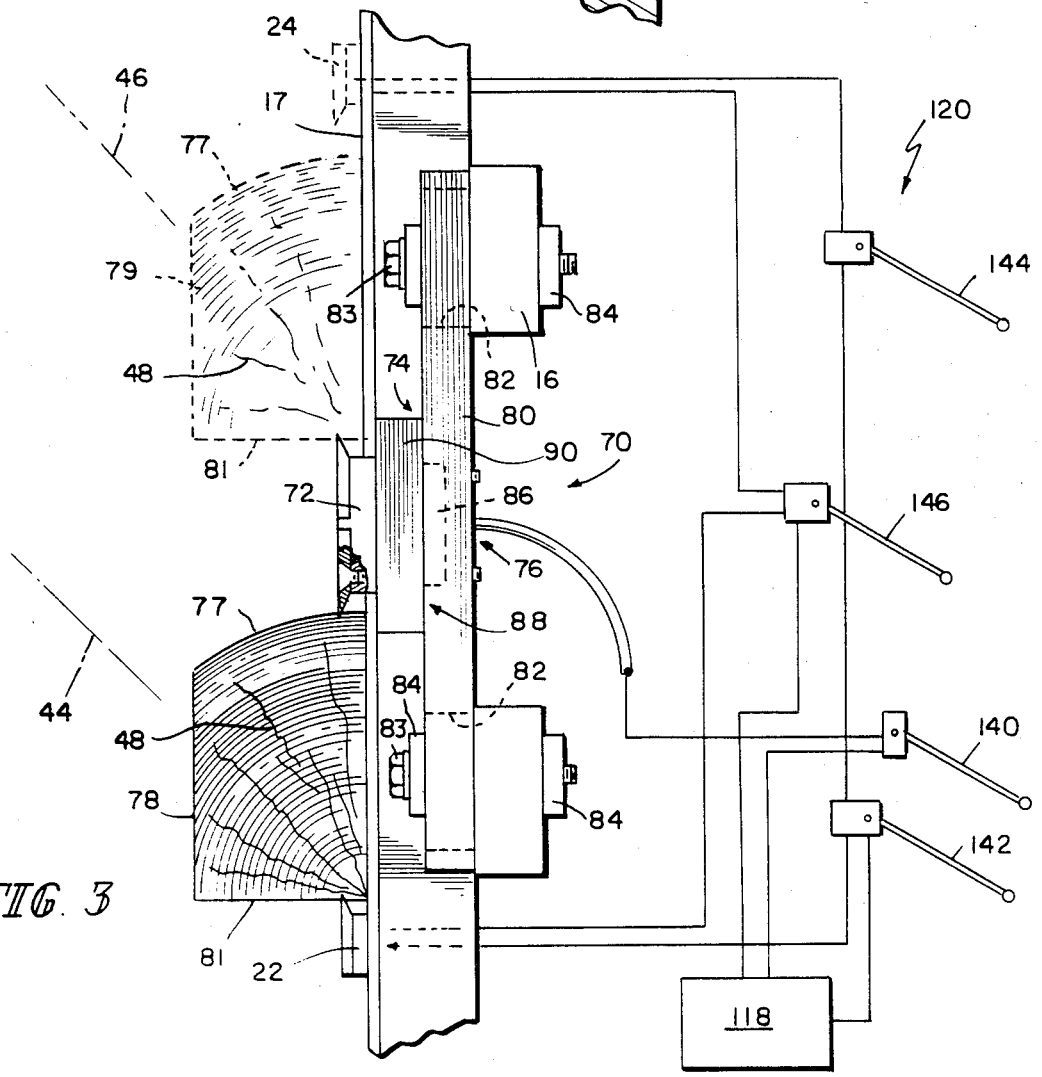
FIG. 3 is an enlarged sectional view, partly broken away and cross-sectioned, of the flitch table shown in FIG. 2 showing the jaws of the intermediate dog cooperating with the jaws of the top and bottom dogs to grip and hold two flitch sections against the mounting surface of the flitch table.

As shown in FIG. 3, a flitch 26 split longitudinally in half would yield two supplementary longitudinal flitch sections 78 and 79. Following the slicing of the flitch 26, the flitch section 78 is longitudinally rotated and mounted on a traditional reciprocating flitch table 16 so that the knife edge 58 first encounters flat surface 81 of the flitch section 78 generally perpendicular to the mounting surface 17, produced by the longitudinal splitting operation, and exits at an arcuate surface 77. It is noteworthy that with the revised mounting position of the flitch section 78, the planes 44 of the medullary rays 48 of the section 78 have a negative slope. The flitch section 79 is mounted on the flitch table 16 in a fashion identical to that of the flitch section 78. The revised mounting position for the flitch section 78 will produce veneer sheets yielding a smooth surface texture since the orientation of the flitch section 78 no longer mirrors the orientation of the flitch section 79, but emulates it. The revised mounting position changes the slope of the planes 44 of the medullary rays 48 of the flitch section 78 prior to slicing from positive to negative and thus eliminates gouging by the knife edge 58.

Individually slicing each flitch section 78 and 79 proves to be a time-consuming and labor-intensive chore. The flitch 26 must be longitudinally split, the flitch section 78 mounted and sliced, the unsliced portion of the flitch section 78 that had been gripped by the conventional dogs 22, 24 must be discarded, the flitch section 79 must be mounted, and the process repeated. The primary disadvantage is inefficient use of the veneer slicer 10 since twice as many passes of the reciprocating flitch table 16 are now required in order to slice the same amount of veneer sheets as was heretofore possible using the traditional set-up. The desired surface texture could be obtained at a substantially reduced cost by slicing both flitch sections 78, 79 in one pass of the reciprocating flitch table 16. Prior to the present invention, the flitch table 16 had no means for gripping more than one flitch or flitch section at a time. A flitch table constructed according to the present invention permits two flitch sections 78 and 79 to be concurrently gripped and constrained against the mounting surface 17 so that they may be sliced simultaneously.

In the preferred embodiment of the present invention, one or more intermediate dog assemblies 70 are mounted on the flitch table 16 and are designed to grip the adjacent inwardly facing surfaces of each of two parallel fitch sections 78, 79 while the opposing outwardly facing surfaces of the two flitch sections 78, 79 are being gripped by the bottom and top dogs 22. 24. As best shown in FIG. 3, the inwardly facing surfaces will include the arcuate surface 77 of the flitch section 78 and the flat surface 81 of the flitch section 79.

The intermediate dog assemblies 70 are projectable beyond the plane of the mounting surface 17 and retractable within the flitch table 16. This unique apparatus permits a single flitch table 16 to constrain either one conventional flitch 26 or two flitch sections 78, 79 against the mounting surface 17 during the slicing operation.

The intermediate dog assemblies 70 are designed to be incorporated on flitch tables 16 of veneer slicers 10 of the type described above. The number of intermediate dog assemblies 70 utilized on a slicer 10 will depend on the length of the slicer, i.e., the length of flitches which can be cut in the slicer. Further, the intermediate dog assemblies 70 are laterally narrow assemblies which can be inserted into laterally narrow spaces on the flitch table 16, each assembly including a frame portion which is connected to the flitch table.

Each intermediate dog assembly 70 includes an intermediate dog 72, mounting means 74, and projecting means 76 for projecting the intermediate dog 72 beyond the plane of the mounting surface 17. The relationship of the intermediate dog assembly 70 to the flitch table 16 is best shown in FIG. 3. The intermediate dog 72 is positioned intermediate the bottom dog 22 and top dog 24 so that the three dogs 22, 72, and 24 cooperate to grip the parallel flitch sections 78, 79 concurrently. In the preferred embodiment, the projecting means 76 includes a fluidic cylinder drive which will be explained hereinafter.

As seen in FIG. 3, the mounting means 74 includes a support bar 80 transversely mounted on the flitch table 16 so that it is recessed behind the plane of the mounting surface 17. The support bar 80 includes a plurality of longitudinal slots 82 symmetrically disposed about a transverse line passing through the center of the support bar 80. The support bar 80 is attached to the flitch table 16 by a plurality of fastening elements 83 and bearing plates 84. A cavity 86 is provided in the central portion of the support bar 80. As shown in FIG. 3, the cavity 86 opens outwardly toward the plane of the mounting surface 17.

Figure 4:
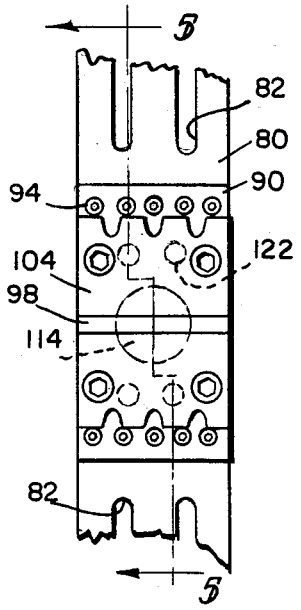
FIG. 4 is a front elevational view of an intermediate dog embodying the present invention.
Figure 5:
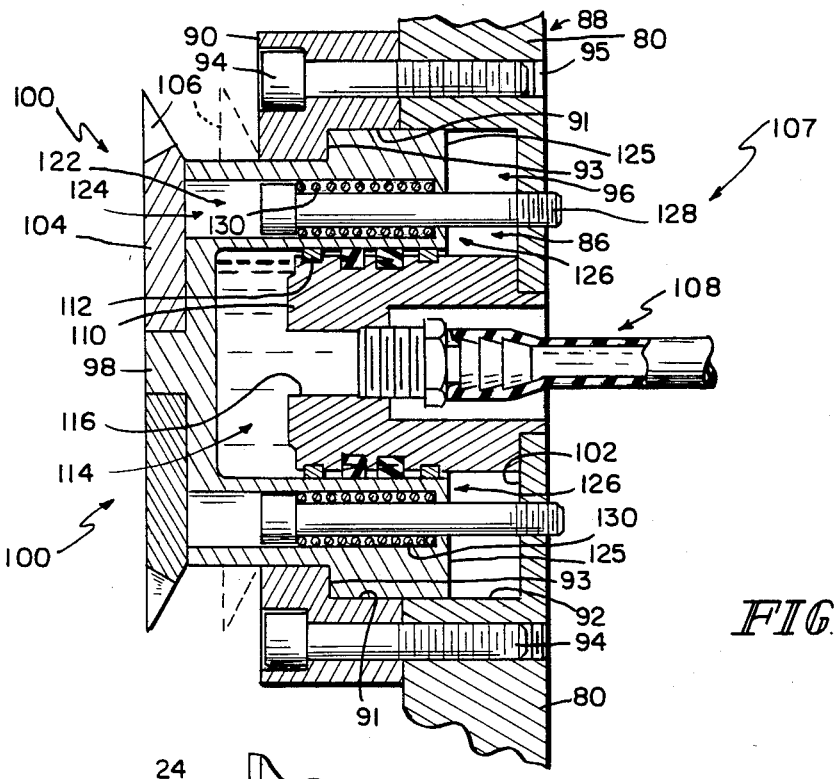
FIG. 5 is a cross-sectional view of the intermediate dog of the present invention taken generally along lines 5—5 of FIG. 4 showing the preferred means for moving the intermediate dog.

Referring to FIGS. 4 and 5, the intermediate dog 72 is carried within a frame 88. The frame 88 is formed by the support bar cavity 86 and a pair of L-shaped gibs 90 which partially enframe the outwardly opening support bar cavity 86. The gibs 90 are mounted to the support bar 80 on opposing sides of the cavity 86 so that they are symmetrically disposed about the opening of the cavity 86. The gibs 90 are mounted on the support bar 80 so that the inwardly facing surface 91 of each gib 90 is flush with the cavity wall 92, and the lip portion 93 of each gib 90 extends inwardly beyond the plane of the cavity wall 92, as shown in FIG. 5. Each gib 90 is mounted to the support bar 80 by a plurality of fastening elements 94 threadedly engaging the support bar 80 as indicated at 95. The inwardly facing surface 91 of the gibs 90 cooperate with the coplanar cavity walls 92 to form a channel 96 normal to the plane of the mounting surface 17.

The intermediate dog 72 includes a T-shaped dogging block 98 and a pair of dogging plates 100 positioned and designed to engage the adjacent inwardly facing surfaces 81 and 77 of the two flitch sections 78, 79, respectively. The dogging block 98 is carried within the fixed frame 88 so that rectilinear movement within the channel 96 is possible. Movement of the dogging block 98 in channel 96 is limited by the inwardly protruding lips 93 of the gibs 90 and the bottom wall 102 of the support bar cavity 86. The intermediate dog assembly 70 is mounted on the flitch table 16 and the depth of channel 96 selected so that the intermediate dog 72 is projectable beyond the plane of the mounting surface 17 and retractable within the flitch table 16 in response to movement of the dogging block 98. Each dogging plate 100 is orthogonally mounted to a portion of the dogging block 98 which is both extendable beyond the plane of the mounting surface 17 and retractable within the flitch table 16. Each dogging plate 100 includes a mounting portion 104 and a jaw portion 106. The mounting portions 104 are secured to the dogging block 98 by a plurality of fastening elements (not shown) so that the jaw portions 106 extend in opposing directions.

The dogging block 98 includes several features which facilitate its movement within the channel 96. In the preferred embodiment of the reciprocating means 107 for moving the dogging block 98 (FIG. 5), the dogging block 98 includes a cylinder bore 108 opening inwardly with respect to the plane of the mounting surface 17. The cylinder bore 108 is designed so that it may receive a floating piston 110 having a plurality of peripherally extending sealing rings 112. The engagement of the piston 110 and the cylinder bore 108 forms a chamber 114 into which a pressurized fluid (not shown) may be injected through an orifice 116 in the piston 110. The introduction of the pressurized fluid will fill the space within the chamber 114, causing the dogging block 98 to move outwardly with respect to the plane of the mounting surface 17 to its projected position, as represented by the solid lines in FIG. 5. The pressurized fluid may be stored in a convenient location 118 near the veneer slicer 10 and may be controlled by a suitable fluidic control system 120 as generally indicated by the schematic diagram in FIG. 3. The purpose of the cylinder drive is to project the intermediate dog 72 beyond the plane of the mounting surface 17 to its projected position.

In addition, the reciprocating means 107 also includes biasing means 122 for biasing the intermediate dog 72 toward its retracted position within the flitch table 16, as represented by the broken lines in FIG. 5. In the preferred embodiment, the dogging block 98 includes a plurality of fixture bores 124 symmetrically disposed about the longitudinal axis of the cylinder bore 108. The fixture bores 124 open outwardly with respect to the mounting surface 17. The openings of the fixture bores 124 are capped by the mounting portions 104 of the dogging plates 100. The dogging block 98 includes a plurality of cylindrical holes 126 in its bottom surface 125 equal in number to the number of fixture bores 124. The cylindrical holes 126 are concentrically aligned with the fixture bores 124 and open toward the bottom wall 102 of the support bar cavity 86. The diameter of the cylindrical hole 126 is smaller than the diameter of the fixture bore 124 so that the threaded portion of a bolt 128 may extend through the cylindrical hole 126 and the head of the unthreaded portion may be seated in the fixture bore 124. The biasing means 122 includes compression springs 130 interposed between the heads of the bolts 128 and the bottoms of the fixture bores 124. The bolts 128 extend through the cylindrical hole 126 and threadedly engage the support bar 80. The springs 130 are designed so that the intermediate dog 72 is seated on the bottom wall 102 of the support bar cavity 86 when the springs 130 are fully extended. Thus, springs 130 bias the intermediate dog toward its retracted position within the flitch table 16.

The preferred reciprocating means 107 employs a fluidic piston-cylinder drive to project the intermediate dog 72 beyond the plane of the mounting surface 17 (as depicted in FIG. 5). Typically, the intermediate dog 72 is biased against the bottom wall 102 of the support bar cavity 26 so that the dogging plates 100 are retracted within the flitch table 16.

Each flitch section 78 and 79 is independently mounted on the mounting surface 17 using the preferred mounting procedure. Operation of the fluidic control system 120 activates movement of the intermediate dogs 72, bottom dogs 22, and top dogs 24. Referring to FIG. 3, the intermediate dogs 72 are moved to their projected positions by operating control means 140. Some of the bottom dogs 22 are moved to their gripping positions by operating control means 142. Some of the top dogs 24 are moved to their gripping positions by operating control means 144. The remaining bottom dogs 22 and top dogs 24 are simultaneously moved to their respective gripping positions by activating control means 146. The first step in the preferred mounting procedure is to move the dogging plates 100 beyond the plane of the mounting surface 17 to their projected positions by operating the control means 140. The second step is to mount the flitch section 78 in its rotated orientation on a lower portion of the mounting surface 17. The flat mounting surface of flitch section 78 is placed against the mounting surface 17 so that the dogging plates 100 engage the longitudinal arcuate surface 77 of the flitch section 78. Some of the bottom dogs 22 are then activated by the control means 142 so that they grip the longitudinal flat surface 81 and constrain flitch section 78 against the mounting surface 17. The third step is to mount the flitch section 79 on an upper portion of the mounting surface 17. The flat mounting surface of flitch section 79 is placed against the mounting surface 17 so that the dogging plates 100 engage the longitudinal flat surface 81 of the flitch section 79. Some of the top dogs 24 are then activated by the control means 144 so that they grip the longitudinal arcuate surface 77 and constrain flitch section 79 against the mounting surface 17. Finally, the remaining bottom dogs 22 and top dogs 24 are simultaneously activated by control means 146 so that the bottom dogs 22 grip the longitudinal flat surface 81 of flitch section 78 and the top dogs 24 grip the longitudinal arcuate surface 77 of flitch section 79.

Sequentially mounting and gripping the flitch sections 78 and 79 prior to slicing both sections is the preferred manner of operation in the present invention. However, this preferred procedure does not preempt the use of alternative operating procedures. For example, the flitch section 79 could be mounted before the flitch section 78 is mounted or both flitch sections 78 and 79 could be mounted and gripped simultaneously.

Alternatively, the reciprocating means could be proportioned and designed so that the intermediate dog is normally spring-biased beyond the plane of the mounting surface. This configuration would remove the need for a fluidic piston-cylinder drive. The flitch table 16 would be set up to accommodate two flitch sections. However if the veneer cutter elected to slice a conventional flitch 26, the springs would allow the intermediate dog 72 to retract within the flitch table under the weight of the flitch 26.

The new intermediate dogs add a significant measure of flexibility to a standard flitch table. Surface texture quality of sliced veneer sheets can be markedly improved with minimal effort following the incorporation of this unique invention into a conventional veneer slicer.

What is claimed is:

1. In a veneer slicer having a reciprocating flitch table providing a mounting surface for a flitch, top and bottom dogs for gripping the flitch and holding the flitch against a central portion of the mounting surface, power means for moving the top and bottom dogs toward the central portion to their gripping positions and away from the central portion to their releasing positions, and a knife and pressure bar assembly movable along a path normal to the mounting surface, the flitch table being reciprocable transverse to the path of the knife and pressure bar assembly, the improvement comprising a dog intermediate the top and bottom dogs for concurrently gripping and holding a first flitch section and a second flitch section against the mounting surface, the intermediate dog having a retracted position within the flitch table and a projected position a distance beyond the plane of the mounting surface, mounting means for mounting the intermediate dog to the flitch table in proximity to the central portion of the mounting surface, the top and intermediate dogs gripping opposite portions of the first flitch section and the bottom and intermediate dogs gripping opposite portions of the second flitch section, and projecting means for moving the intermediate dog from the retracted position to the projected position.

2. The improvement of claim 1 wherein the projecting means includes spring means yieldably biasing the intermediate dog toward at least one of its projected and retracted positions.

3. The improvement of claim 2 wherein the projecting means includes piston and cylinder mechanism for projecting the intermediate dog to its projected position, and the spring means yieldably biases the intermediate dog toward its retracted position.

4. The improvement of claim 1 wherein the mounting means includes a support bar mounted on the flitch table, the support bar including a cavity for receiving the intermediate dog such that the intermediate dog is free to move along a path normal to the plane of the mounting surface, a frame constraining the movement of the intermediate dog, and means for attaching the frame to the support bar.

5. The improvement of claim 1 in which the intermediate dog includes a dogging block and a pair of jaws mounted on the dogging block for engaging adjacent inwardly facing surfaces of the flitch sections.

6. A veneer slicer having a reciprocating flitch table, the flitch table providing a mounting surface for a flitch, top and bottom dogs for gripping the flitch and holding the flitch against the mounting surface, and a knife and pressure bar assembly movable along a path normal to the mounting surface, the improvement comprising a dog intermediate the top and bottom dogs, the top dog and the intermediate dog gripping and holding a first flitch section, the intermediate dog and bottom dog gripping and holding a second flitch section, means for mounting the intermediate dog to the flitch table, and means for projecting the intermediate dog from a retracted position within the flitch table to a projected position a distance beyond the plane of the mounting surface, the projecting means including means for yieldably biasing the intermediate dog toward at least one of its projected and retracted positions relative to the plane of the mounting surface.

* * * * *